US009255572B2

(12) United States Patent
Bundy

(10) Patent No.: US 9,255,572 B2
(45) Date of Patent: Feb. 9, 2016

(54) PORTABLE PUMPING UNIT BASE

(71) Applicant: Roger D. Bundy, Lubbock, TX (US)

(72) Inventor: Roger D. Bundy, Lubbock, TX (US)

( * ) Notice: Subject to any disclaimer, the term of this patent is extended or adjusted under 35 U.S.C. 154(b) by 0 days.

(21) Appl. No.: 14/220,745

(22) Filed: Mar. 20, 2014

(65) Prior Publication Data

US 2014/0284448 A1 Sep. 25, 2014

Related U.S. Application Data

(60) Provisional application No. 61/803,536, filed on Mar. 20, 2013.

(51) Int. Cl.
*F16M 13/00* (2006.01)
*F04B 47/02* (2006.01)

(52) U.S. Cl.
CPC ..... *F04B 47/02* (2013.01)

(58) Field of Classification Search
CPC ..... F16M 13/00
USPC ..... 248/678, 346.01, 346.4, 188.1, 188.2, 248/614, 618, 906; 108/51.11, 55.1, 55.3, 108/57.17, 57.19, 57.21, 57.25, 57.29, 108/57.34, 150; 220/3.2–3.94
See application file for complete search history.

(56) References Cited

U.S. PATENT DOCUMENTS 2,998,216 A * 8/1961 Hurd ..... 248/679
3,095,837 A * 7/1963 Skubic ..... 108/53.5
3,361,399 A 1/1968 Hestand et al.
3,626,702 A 12/1971 Monahan
3,707,165 A * 12/1972 Stahl ..... E04C 2/521 137/375
3,994,241 A * 11/1976 Evans ..... 108/53.5
4,134,636 A * 1/1979 Kleinatland ..... H02G 3/123 174/58
4,505,449 A * 3/1985 Turner et al. ..... 248/669
4,667,840 A * 5/1987 Lindsey ..... H02G 3/125 174/504
4,700,923 A * 10/1987 Lewis et al. ..... 248/679
5,110,082 A * 5/1992 Rowan, Jr. ..... 248/678
5,238,215 A * 8/1993 Jeker et al. ..... 248/638
5,277,395 A * 1/1994 Smith et al. ..... 248/679
5,464,188 A 11/1995 Priebe et al.
5,771,645 A * 6/1998 Porter ..... E04C 2/243 29/897
6,245,826 B1 6/2001 Wilson et al.
6,268,402 B1 7/2001 Wilson et al.
6,395,384 B1 * 5/2002 Adam ..... 428/319.3
6,518,499 B1 * 2/2003 Kessler ..... 174/50
6,550,741 B1 * 4/2003 Cottone ..... 248/678
6,874,295 B2 * 4/2005 Anderson ..... H02G 3/12 156/295
7,001,948 B2 2/2006 Gupta et al.
7,802,526 B2 * 9/2010 Brady et al. ..... 108/53.5
7,918,165 B2 * 4/2011 Owen ..... 108/55.1
7,947,901 B2 * 5/2011 Leopold ..... H02G 3/088 174/50
7,952,022 B2 * 5/2011 Rippel ..... H02G 3/125 174/50
8,049,107 B2 * 11/2011 Dinh ..... H02G 3/14 174/50
8,136,782 B2 * 3/2012 Rowland ..... 248/346.2
2006/0213402 A1 * 9/2006 Grimal ..... 108/51.11
2007/0215614 A1 * 9/2007 Matsui ..... H05K 5/0069 220/3.2
2010/0019121 A1 * 1/2010 Asplund et al. ..... 248/678
2011/0303128 A1 * 12/2011 Linares ..... 108/51.3

* cited by examiner

*Primary Examiner* — Terrell McKinnon
*Assistant Examiner* — Michael McDuffie
(74) *Attorney, Agent, or Firm* — Sarah Hegi Simpson; McWhorter, Cobb & Johnson, LLP

(57) ABSTRACT

A portable pumping unit base for receiving and anchoring a pumping unit thereto is disclosed herein. The disclosed base generally comprises a body made of a rigid polyurethane foam system, said rigid polyurethane foam system comprising an isocyanate component and a polyol resin component. Additionally, the disclosed base made of said rigid polyurethane foam system may be encapsulated in a polyurea coating.

11 Claims, 2 Drawing Sheets

PORTABLE PUMPING UNIT BASE

CROSS-REFERENCE TO RELATED APPLICATIONS

This application is related to and claims priority from earlier filed U.S. Provisional Patent Application No. 61/803,536, filed Mar. 20, 2013, the disclosure of which is incorporated herein by reference.

BACKGROUND OF THE INVENTION

1. Field of the Invention

The present invention relates generally to a pumping unit base. More specifically, the present invention relates to a portable base for receiving and anchoring pumping units thereto, wherein the pumping units are designed for lifting oil or other liquids out of the ground.

2. Description of Related Art

As is well known in the oil and gas industry, pumping units, also known as pumpjacks, are often used to mechanically lift liquid out of wells when there is a lack of sufficient bottom hole pressure for the liquid to flow to the earth's surface. While various pumping units are available for use, all such units must be anchored solidly to either a foundation embedded in the ground or to a prefabricated base attached to the ground.

Due to the extreme weight of pumping units, as well as the heavy impact and vibration caused by pumping units during the pumping of wells, it has been the practice heretofore to make pumping unit foundations and bases from concrete. The pumping unit foundation or base must be able to provide a strong, level and stable support for the extremely heavy pumping unit attached thereto. As a result, no one has, until now, been able to develop a pumping unit foundation or base of any material other than concrete. The use of concrete to make pumping unit foundations and bases, however, has numerous problems and disadvantages that are overcome by the present invention.

In the case of poured concrete foundations, a pumping unit can be mounted to a stationary concrete foundation, which requires excavation, building a form, and pouring the concrete, with the ensuing waiting period for the concrete to set and to properly harden before the pumping unit can be placed thereon for use. This time-consuming process takes many days, resulting in the loss of production time, increased costs and decreased earnings. Additionally, once the pumping unit is no longer needed, the foundation is no longer useful and the concrete becomes waste material which must be disposed of in a costly manner. Removal and transport of the heavy concrete foundation away from the well site is expensive and laborious, and has become such an issue that oil and gas companies have been known to leave concrete foundations on a landowner's land after the pumping units are removed, leaving the burden of removing and disposing of concrete foundations up to the landowner.

In response to the problems associated with poured concrete foundations, portable concrete bases were developed for receiving and anchoring pumping units thereto. Portable concrete bases are cast at a production plant in a form structure that is removed after the concrete is set. The bases are then transported to the required site. Portable concrete bases, however, experience many of the same problems seen with poured concrete foundations.

Portable concrete bases are extremely heavy, typically weighing between 6,500 to 8,500 pounds, which results in great expense, labor and safety concerns associated with the transport of these concrete bases to oil and gas drilling fields Likewise, once the pumping unit is no longer being used, transport of concrete bases away from the field is, again, expensive, laborious and dangerous.

Additionally, concrete foundations and bases cannot be poured or manufactured in cold climate regions during times when temperatures fall below freezing, as water is one of the components of concrete and if the water freezes, it ruins the internal structure of the concrete. As a result, concrete bases are manufactured in areas having warmer climates and shipped, oftentimes long distances, to reach well sites in regions with cold climates.

Currently, a need exists for a pumping unit base that maintains the characteristics of extreme strength, durability and stability, yet has improved portability and practicality. While concrete materials are typically used for permanent building structures, pumping units are not permanent in nature and eventually require removal. Therefore, there is a need for a more portable and practical solution to support pumping units. An improved pumping unit base is needed that has characteristics that make it easier and less expensive to move into a drilling field for use, as well as easier and less expensive to move out of a drilling field once the attached pumping unit is no longer being used. Additionally, a pumping unit base is needed that is able to withstand outdoor elements and is able to support a heavy operating pumping unit. Unlike existing concrete bases that require the use of large trucks and winching equipment for handling and maneuvering such bases, a need exists for a base that is sufficiently light that it can be handled and maneuvered by workers rather than requiring heavy, expensive machinery.

In view of the foregoing, it is apparent that a need exists in the art for a portable pumping unit base which overcomes, mitigates or solves the above problems in the art. It is a purpose of this invention to fulfill this and other needs in the art which will become more apparent to the skilled artisan once given the following disclosure.

OBJECTS AND SUMMARY OF THE INVENTION

It is an object of the present invention to overcome the above-described drawbacks associated with current pumping unit foundations and bases. To achieve these and other advantages and in accordance with the purpose of the invention, as embodied and broadly described, the present disclosure describes a portable pumping unit base made of a rigid polyurethane foam system. By utilizing polyurethane foam to make the disclosed pumping unit base, the disclosed base is able to overcome the above-described drawbacks associated with concrete foundations and bases.

The disclosed base provides a strong, level and stable support for extremely heavy pumping units anchored thereto. At the same time, the disclosed base is sufficiently lightweight, generally weighing less than 300 pounds, and thus can be lifted, carried, set in place, and removed by workers without requiring the assistance of expensive machinery. Unlike existing concrete bases, the disclosed base does not require large trucks and winching equipment for handling and maneuvering the disclosed base.

The disclosed base provides an improved pumping unit base that is not only portable, but also is easily transportable to and from a well site. It is much less expensive, laborious and dangerous to transport the disclosed base from a production plant to a well site compared to the transport of current concrete pumping unit bases. Then, once the pumping unit has completed its job, the disclosed base can be easily moved for reuse or disposal, without the need of heavy equipment and machinery to dispose of or move the base.

Furthermore, the disclosed pumping unit base is easy to construct and comparatively low in cost to manufacture compared to current concrete bases.

These, together with other objects of the invention, along with various features of novelty that characterize the invention, are pointed out with particularity in the claims annexed hereto and forming a part of this disclosure. For a better understanding of the invention, its operating advantages, and the specific objects attained by its uses, reference should be had to the accompanying drawings and descriptive matter in which there is described illustrative embodiments of the invention.

BRIEF DESCRIPTION OF THE DRAWINGS

The accompanying drawings, which are incorporated in and forma part of the specification, illustrate embodiments of the present invention, and together with the description, serve to explain the principles of the invention. It is to be expressly understood that the drawings are for the purpose of illustration and description only and are not intended as a definition of the limits of the invention.

In the drawings.

DETAILED DESCRIPTION OF ILLUSTRATIVE EMBODIMENTS

The terms "top," "bottom," "side," and "end" are used in the specification to describe the embodiment of the invention as illustrated in the accompanying Figures. It should be appreciated that in actual use, an embodiment of the invention may be rotated as needed to accomplish the objectives of the invention. As a result of such rotation, the various terms used herein of "top," "bottom," "side," "end," and the like may not literally apply to a particular arrangement. Such terms are relative and are used herein to describe the Figures for illustration purposes only and are not intended to limit the embodiments shown to any particular orientation.

Figure 1:
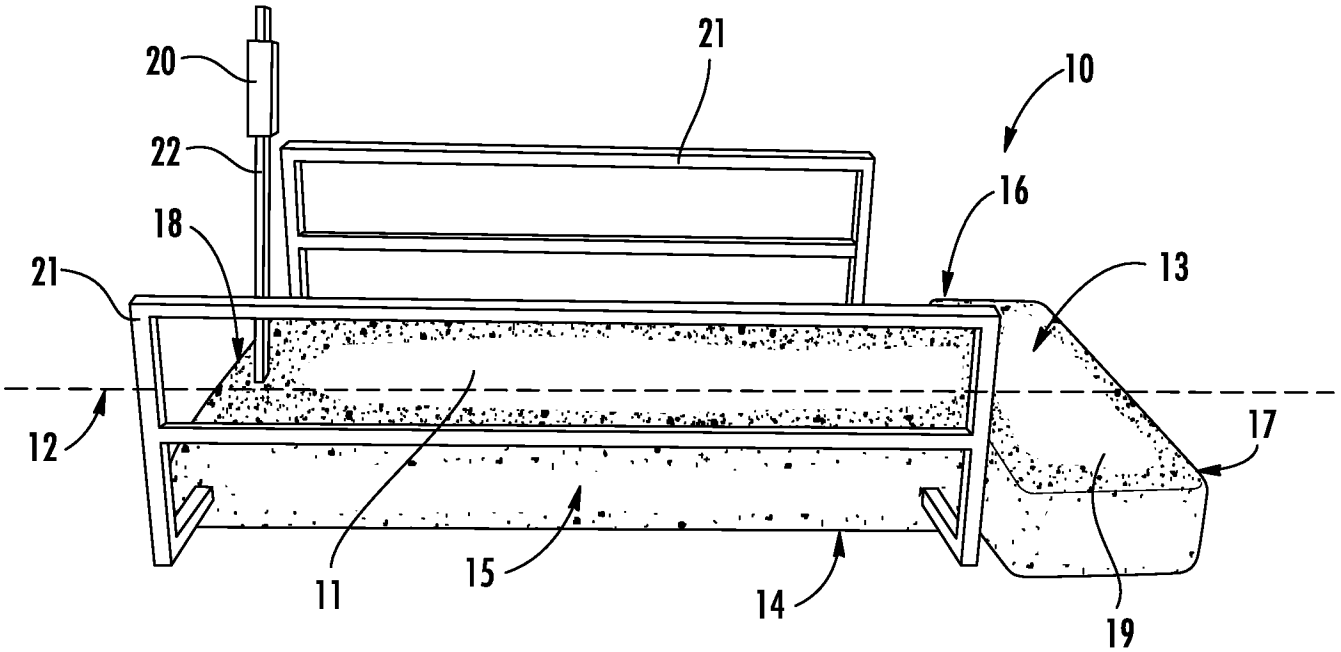
FIG. 1 is a side perspective view of a base constructed in accordance with the teachings of the present disclosure.
Figure 2:
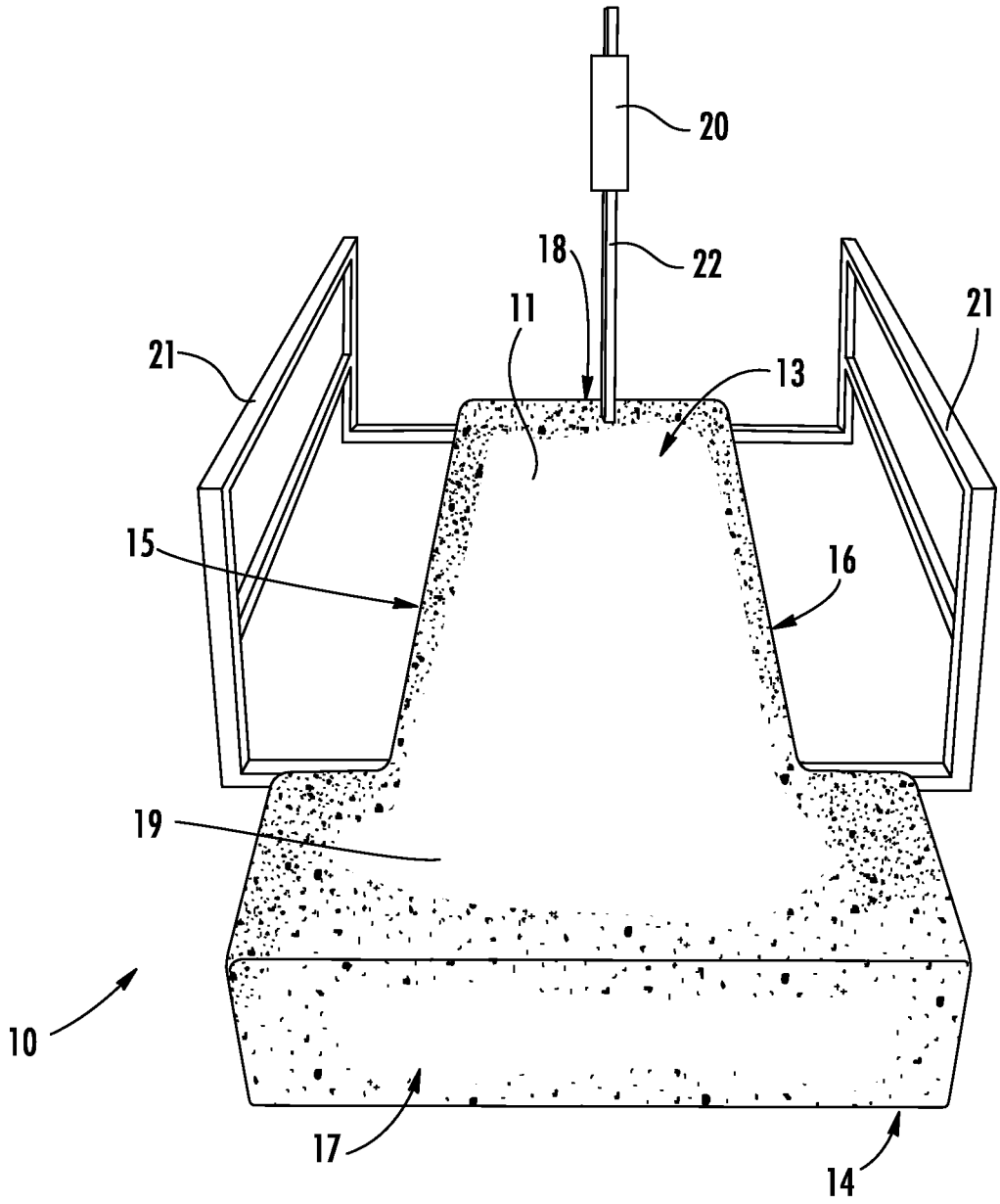
FIG. 2 is a top perspective view of the base shown FIG. 1.

Referring now to FIGS. 1-2, exemplary embodiments of a portable pumping unit base 10 in accordance with the present disclosure are illustrated.

Turning to FIG. 1, a portable pumping unit base 10 according to the present disclosure is illustrated and generally includes a body 11 made of a rigid polyurethane foam system, wherein the body 11 includes a long axis 12 extending the length of the body 11, a top surface 13, a bottom surface 14, opposing side surfaces 15 and 16, and opposing end surfaces 17 and 18.

As shown in the attached drawings, the body 11 includes a long axis 12 extending the length of the body 11. The long axis 12 should be at least as long as the bottom portion of the pumping unit (not illustrated) that is secured to the base 10. As pumping units are made in various shapes and sizes, the length of the long axis 12 will vary according to the size of the pumping unit secured thereto.

In one embodiment contemplated by the present disclosure, the opposing side surfaces 15 and 16 and the opposing end surfaces 17 and 18 of the body 11 are approximately ten to eleven inches in height; however, the height may vary according to the size of the pumping unit secured thereto.

The body 11 of the disclosed pumping unit base 10 is made of a rigid polyurethane foam system. The term "polyurethane" describes any polymer composed of a chain of organic units, joined by urethane links. A purely polyurethane foam is the result of a reaction between an isocyanate component and a resin blend made with only hydroxyl-containing resins. The final foam will contain no intentional urea groups. A polyurethane system will most likely contain one or more catalysts.

A non-limiting example of an appropriate foam material used to make the disclosed base 10 is sold under the trade name ELASTOPOR® Rigid Polyurethane Foam System, manufactured by BASF Corporation (Florham Park, N.J.); www.basf.com. The ELASTOPOR® Rigid Polyurethane Foam System is a two component system comprising a polyol resin component (e.g., ELASTOPOR® P 15390R Resin) and an isocyanate component (e.g., ELASTOPOR® P 1001U Isocyanate).

The ELASTOPOR® Rigid Polyurethane Foam System is a two-component polymeric MDI-based system utilizing water and 1,1,1,3,3-Pentafluoropropane (HFC-245fa) as blowing agents. The ELASTOPOR® P 15390R Resin component is a urethane system resin component with a density at 55° F. of 9.06 lbs/gal, viscosity at 73° F. of 360 cps, flash point (ASTM 3278-89) of greater than 200° F., and HFC-245fa percentage resin of 7.6%. The ELASTOPOR® P 1001U Isocyanate component is a polymethylene polyphenylisocyanate with a density at 77° F. of 10.2 lbs/gal, viscosity at 77° F. of 200 cps, flash point (ASTM 3278-89) of greater than 400° F., and vapor pressure at 20° F. of 0.00016 mm Hg. The mix ratio of the ELASTOPOR® P 15390R Resin component and the ELASTOPOR® P 1001U Isocyanate component in parts by weight is 92 resin/100 isocyanate.

Another suitable polyurethane foam is the Urethane Pour Foam commercially available from US Composites (West Palm Beach, Fla.); www.uscomposites.com. The Urethane Pour Foam by US Composites is a rigid polyurethane closed-cell, pourable foam. It is available in 2 lb., 3 lb., 4 lb., 8 lb., and 16 lb. densities, said densities referring to the weight per cubic foot of expanded foam. The 4 pound density Urethane Pour Foam has a free rise density of 4 pounds per cubic foot, an expansion rate of approximately 15 times its liquid volume, a parallel compressive strength of 90 psi, a tensile strength of 110 psi, a shear strength of 70 psi, and a flexural strength of 120 psi.

Other non-limiting examples of suitable polyurethane foam compositions include those disclosed in U.S. Pat. Nos. 6,245,826 and 6,268,402 by Wilson et al., the disclosures of which are hereby incorporated by reference herein.

The polyurethane foams used to make the disclosed base are produced by mixing two liquid components. The two components are referred to as a polyurethane system. The first component is an isocyanate component, which is commonly referred to as "Part A." The second component is a polyol component, containing catalysts, surfactants, blowing agents, and other additives, and is commonly referred to as "Part B" or the resin blend.

In one embodiment contemplated by the present disclosure, the polyurethane foam system utilized is a two part, pourable liquid that, when the isocyanate component and the polyol resin component are combined and mixed thoroughly, will expand into a rigid polyurethane closed-cell foam. Containers are required to measure and mix the resin component and the isocyanate component and a high speed drill mixer is recommended for stirring together the two liquid components.

After combining the two components, a user has approximately 45 seconds before the foaming process begins The liquids should be stirred vigorously for approximately 25 seconds, after which time the user has another approximately 20 seconds to pour the foam into a mold. The foam will fully expand in approximately 5 minutes. It should be noted that these times are approximate and may vary depending on the exact formulation of the selected foam.

Once the polyurethane components are combined, the mixed liquid components are poured into a mold to allow the components to fully foam and react. The interior portion of the mold defines a cavity for receiving the poured foam. The mold may have a reinforcement structure (e.g., metal framing) formed outside the mold. The interior portion of the mold may be covered with a release agent or other material to ensure parting of the molded body from the surface on which it is molded.

For example, the mold may be made of wood with a wax-based non-silicone release agent applied to the interior walls of the mold. Such a wooden mold would preferably have a metal framing disposed outside the walls to reinforce the walls of the mold to prevent the expanding foam from blowing out the walls of the mold. Once the polyurethane foam is poured into the cavity, the foam expands and fills the mold cavity. Then, once the foam cures, the molded body 11 can be easily removed from the mold.

In the attached drawings, the body 11 is formed in a T-shape. A T-shaped mold is used to make a T-shaped body 11. In the embodiment wherein the body 11 is formed in a T-shape, the body 11 includes a head member 19 that is positioned at one end of the elongated body 11 of the base 10. The head member 19 is disposed transverse to the long axis 12 of the body 11. One skilled in the art can appreciate that the body 11 may be configured in many different shapes and, therefore, many different shapes and configurations of molds may be used to form the body 11. For example, in another preferred embodiment, the body is formed in a rectangular shape, and a rectangular shaped mold is used to form the rectangular shaped body.

In another preferred embodiment contemplated by the present disclosure, the body 11 of the disclosed base 10 is made of a polyurethane foam encapsulated in a polyurea spray foam coating. The polyurea coating is a spray applied, high performance barrier coating that provides an extremely strong protective coating to the base 10.

Polyurea coatings are derived from the reaction product of an isocyanate component and a resin blend (or amine blend) component. The isocyanate can be aromatic or aliphatic in nature, and the isocyanate can be monomer based, a prepolymer, a polymer or any variant reaction of isocyanates, quasi-prepolymer or a prepolymer. The prepolymer, or quasi-prepolymer, can be made of an amine-terminated polymer resin or a hydroxyl-terminated polymer resin. On the other hand, the resin blend only contains amine-terminated polymer resins and/or amine-terminated chain extenders. The amine-terminated polymer resins will not have any intentional hydroxyl moieties. Any hydroxyls are the result of incomplete conversion to the amine-terminated polymer resins. The resin blend may also contain additives, or non-primary components. These additives may contain hydroxyls, such as pre-dispersed pigments in a polyol carrier. Normally, the resin blend will not contain a catalyst.

The main distinguishing characteristic of the polyurea technology over polyurethanes is that amine terminated (—$NH_2$) resins are used rather than hydroxyl terminated (—OH) resins, commonly referred to as polyols. The reaction of the amine terminated resins with the isocyanate component results in the formation of a urea linkage. Since this is a polymer and these units repeat, the term polyurea is used to describe such polymers.

The polyurea spray foam coating utilized in the practice of the present invention is the reaction product of an isocyanate component and an amine blend component. In one embodiment contemplated by the present disclosure, the isocyanate component includes diphenylmethane diisocyanate (MDI) and propylene carbonate as the reactive diluent for polyurea. The amine blend includes a mixture of polyetheramines and chain extenders. The main component of the amine blend is a mixture of amine terminated ethylene oxide and/or propylene oxide polyether with molecular weights varying from 200 to 5000 g/mole. The primary amine groups provide a fast and reliable reaction with the NCO-groups of the isocyanate component. Diethyl-toluenediamine (DETDA) may be the chain extender used, which is used to make an aromatic polyurea spray coating. Other chain extenders, such as dimethylthio-toluenediamine (DMTDA); N,N'-di(sec-butyl)-amino-biphenyl methane (DBMDA); or 4,4'-methylene-bis-(3-chloro-2,6-diethyl)-aniline (MCDEA), may also be used. Additives, pigments, and fillers may also be introduced to the amine blend formulation.

Non-limiting examples of suitable polyurea coating compositions include POLYEURO® 5502, POLYEURO® 5502-PW, POLYEURO® 5502F, POLYEURO® 5602, and POLYEURO® 5901, which are all commercially available from Polycoat Products, a division of American Polymer Corporation (Sante Fe Springs, Calif.); www.polycoatusa.com. These two-component aromatic polyurea protective coatings are fast setting, rapid curing, 100% solids, flexible, aromatic, two-component spray polyurea protective coatings that can be applied to the surface of the base 10. The extremely fast gel times make these coatings suitable for applications down to −20° F. The isocyanate composition is called Part-A and the amine composition is called Part-B.

The POLYEURO® 5602, for example, has a mix ratio by volume of 1A:1B; a pot life at 150° F. of 2-4 seconds; a tack free time of 15-30 seconds; a recoat time of 0-12 hours; a viscosity at 150-160° F. (66.5-71° C.) for Part-A of 120±20 cps and for Part-B of 40±20 cps; a density (Parts A & B combined) of 8.9 lbs/gal; a flash point of greater than 200° F.; a 60±5 Shore D hardness; a tensile strength of 2800±200 psi; a tear strength of 285±50 pli; exhibits 300%±20% elongation upon curing; dry service temperature of −40° F. to 250° F.; and wet service temperature of 40° F. to 120° F.

Other suitable polyurea coatings include POLYEURO® 7502 and POLYEURO® 7901, which also are commercially available from Polycoat Products. These two-component aliphatic polyurea protective coatings are fast setting, rapid curing, 100% solids, flexible, aliphatic, spray protective coatings that have extremely fast gel times that make them suitable for applications down to −20° F. The isocyanate composition is called Part-A and the amine composition is called Part-B.

The POLYEURO® 7502, for example, has a mix ratio by volume of 1A:1B; a pot life at 160° F. of 10-15 seconds; a tack free time of 60-120 seconds; a recoat time of 0-6 hours; a viscosity at 150-160° F. (66.5-71° C.) for Part-A of 120±20 cps and for Part-B of 40±20 cps; a density (Parts A & B combined) of 8.50 lbs/gal; a flash point of greater than 200° F.; a 50±5 Shore D hardness; a tensile strength of 3300±300 psi; a tear strength of 400±20 pli; exhibits 220%±20% elongation upon curing; dry service temperature of −40° F. to 300° F.; wet service temperature of 40° F. to 120° F.; and VOC content of 0 gm/lit.

Other examples of suitable polyurea coating compositions include those disclosed in U.S. Pat. No. 7,001,948 by Gupta et al., the disclosure of which is hereby incorporated by reference herein.

The most important element of handling polyurea coatings is the mixing. Good mixing of the isocyanate component and the resin component can be obtained in a suitable mixing module by impingement with mechanical purge. Operational pressure and temperature of the products will also help to optimize the mixing efficiency. Both Part-A and Part-B materials should be preconditioned to approximately 80-90° F. before application. The polyurea coating should be applied using plural component, heated, high pressure 1:1 spray mixing equipment. Both Part-A and Part-B materials should be sprayed at a minimum of 2000 psi and at temperatures above 150° F. Adequate pressure and temperature should be maintained at all times.

The polyurea coating should be applied to the body 11 of the base 10 to a thickness of approximately 80 to 150 mils thick. The polyurea coating should be sprayed in smooth, multidirectional passes to improve uniform thickness and appearance.

The polyurea coating layer applied to the body 11 of the base 10 may be aromatic, aliphatic, or a blend of both aromatic and aliphatic. Various pigments, fillers, solvents and/or additives can be introduced into the coating as well.

In alternative embodiments, hybrid polyurethane/polyurea coatings may be utilized to coat the body 11 of the disclosed base 10. A polyurethane/polyurea hybrid coating has a composition which is a combination of a polyurethane coating system and a polyurea coating system. The isocyanate component can be the same as for the "pure" polyurea systems. The resin blend is a blend of amine-terminated and hydroxyl-terminated polymer resins and/or chain extenders. The resin blend may also contain additives, or non-primary components. To bring the reactivity of the hydroxyl-containing resins to the same level of reactivity as the amine-terminated resins, the addition of one or more catalysts is necessary.

One such hybrid polyurethane/polyurea coating is POLYEURO® 8245 two component aromatic polyurethane polyurea protective coating, which is commercially available from Polycoat Products, a division of American Polymer Corporation (Sante Fe Springs, Calif.); www.polycoatusa.com. The POLYEURO® 8245 coating is a fast setting, rapid curing, 100% solids, flexible, aromatic, two-component spray polyurethane polyurea protective coating that can be applied to cover the top surface 13, bottom surface 14, opposing side surfaces 15 and 16, and opposing end surfaces 17 and 18 of the body 11 of the base 10. Its extremely fast gel time makes it suitable for applications down to −20° F. The isocyanate composition is called Part-A and the resin composition is called Part-B.

The POLYEURO® 8245 has a mix ratio by volume of 1A:1B; a pot life at 160° F. of 5-10 seconds; a tack free time of 40-80 seconds; a recoat time of 0-2 hours; a viscosity at 150-160° F. (66.5-71° C.) for Part-A of 200±100 cps and for Part-B of 500±20 cps; a density (Parts A & B combined) of 8.75 lbs/gal; a flash point of greater than 200° F.; a 45±5 Shore D hardness; a tensile strength of 1300±200 psi; a tear strength of 230±30 pli; exhibits 40%±20% elongation upon curing; dry service temperature of −40° F. to 250° F.; and wet service temperature of 40° F. to 120° F.

Such a polyurethane/polyurea coating layer should be applied to the body 11 of the base 10 to a thickness of approximately 80 to 150 mils thick.

The elongated body 11 of the pumping unit base 10 may further comprise a plurality of spaced apart apertures (not illustrated) extending therethrough for receiving anchor members. The anchor members secure the pumping unit to the body 11 and secure the base 10 to the earth's surface to keep the base 10 in a fixed and stable position. The anchor members are passed through apertures in the pumping unit and driven or set into the earth to keep the base 10 from moving with respect to the earth from the location and orientation in which the base 10 is originally set.

In the embodiment shown in the attached drawings, the base 10 further includes a junction box 20 attached thereto and disposed near the second end surface 18 of the body 11. The junction box 20 conceals and protects the electrical wiring junctions for the pumping unit secured to the disclosed base 10.

As shown in the attached drawings, the junction box 20 may be connected to an elongated support member 22, which may be configured to house electrical wires. For example, the support member 22 may include a conduit pipe or the like for enclosing and protecting the electrical wires, as well as for providing a secure and stable support for the junction box 20.

Additionally, in certain embodiments of the disclosed base 10, the top surface 13 of the body 11 of the base 10 may further include a conduit formed therein, wherein the conduit runs in the direction of the long axis 12 of the body 11. Such a conduit is arranged and configured to receive electrical wires running from an attached pumping unit to the junction box 20.

Furthermore, as shown in the embodiment depicted in the accompanying drawings, the disclosed base 10 may further include guardrails 21 that vertically extend from each of the opposing side surfaces 15 and 16 of the body 11. Such guardrails 21 are designed to keep people and animals from straying into the dangerous area around an attached pumping unit.

With concrete bases and foundations, guardrails 21 are mounted into the ground surface rather than forming an all-in-one unit with the base 10. The disclosed device, however, provides an all-in-one pumping unit base 10 by attaching guardrails 21 directly to the base 10. This saves time when setting up the base 10 and pumping unit, as workers do not have to separately install guardrails to surround the pumping unit.

In another embodiment contemplated by the present disclosure, the disclosed base 10 may further include a chemical containment stand (not illustrated) attached to the head member 19 of the body 11. Such a chemical containment stand is arranged and configured to contain chemical spills.

Therefore, the present disclosure contemplates not only a lightweight, portable pumping unit base 10 made of a rigid polyurethane foam encapsulated in a polyurea coating, but also contemplates an all-in-one base 10 featuring guardrails 21, an attached junction box 20, and a chemical containment stand as part of the base 10.

In one embodiment contemplated by the present disclosure, the body 11 of the base 10 has a long axis 12 that is approximately 34 feet long, the width of the body 11 is approximately 50 inches wide, the width of the head member 19 is approximately 80 inches wide, the opposing side surfaces 15 and 16 are approximately 10 inches tall, and the opposing end surfaces 17 and 18 are approximately 10 inches tall. In standard test experiments using such a configuration, the body 11 was able to support approximately 180,000 to 220,000 pounds. Furthermore, the body 11 weighed less than 300 pounds.

As discussed above, current pumping unit bases made of concrete typically weigh between 6,500 and 8,500 pounds and, therefore, require cranes and heavy equipment to move the bases. The disclosed base 10 has been found to easily support the weight of a pumping unit and the movement and vibration of a pumping unit during operation, and at the same time the disclosed base 10 is made of a material that is so lightweight that two people can easily lift and carry the base 10 without the use of equipment.

It is important to note that the construction and arrangement of the elements of the base provided herein are illustrative only. Although only a few exemplary embodiments of the present invention have been described in detail in this disclosure, those skilled in the art who review this disclosure will readily appreciate that many modifications are possible in these embodiments (such as variations in orientation of the components of the system, sizes, structures, shapes and proportions of the various components, etc.) without materially departing from the novel teachings and advantages of the invention.

Many other uses of the present invention will become obvious to one skilled in the art upon acquiring a thorough understanding of the present invention. Once given the above disclosures, many other features, modifications and variations will become apparent to the skilled artisan in view of the teachings set forth herein. Such other uses, features, modifications and variations are, therefore, considered to be a part of this invention, the scope of which is to be determined by the following claims.

The invention claimed is:

1. A portable pumping unit base for receiving and anchoring a pumping unit thereto, said pumping unit being arranged and configured to lift liquids out of the ground, said base comprising:

a body comprising: a long axis extending the length of the body; a top surface; a bottom surface; opposing side surfaces; and opposing end surfaces; a junction box disposed above said top surface of said body in a manner in which said junction box does not directly contact said top surface; and a junction box support member being partially embedded within said body, said junction box support member being arranged and configured to support said junction box above said body, and said junction box support member being hollow for housing electrical wires therethrough, wherein said body is made of a rigid polyurethane foam system, further comprising a guardrail attached to said base, said guardrail having a first end and a second end, wherein said first end and said second end are partially embedded within said body and extend horizontally from one of said opposing side surfaces of said body, and wherein said guardrail further comprises a frame that extends vertically from said first end and from said second end, said frame being arranged and configured to guard said pumping unit.

2. The base according to claim 1, wherein said body made of said polyurethane foam system has a density between 4 pounds per cubic foot of expanded foam and 16 pounds per cubic foot of expanded foam.

3. The base according to claim 1, wherein said body made of said rigid polyurethane foam system is coated in a polyurea coating.

4. The base according to claim 3, wherein said polyurea coating is the reaction product of an isocyanate component and an amine blend component.

5. The base according to claim 4, wherein said isocyanate component includes diphenlymethane diisocyanate and propylene carbonate as a reactive diluent.

6. The base according to claim 4, wherein said amine blend includes polyetheramines and chain extenders.

7. The base according to claim 6, wherein said chain extenders are selected from a group consisting of diethyltoluenediamine; dimethylthio-toluenediamine; N,N'-di(sec-butyl)-amino-biphenyl methane; and 4,4'-methylene-bis-(3-chloro- 2,6-diethyl)-aniline.

8. The base according to claim 3, wherein said polyurea coating covers said top surface, said bottom surface, said opposing side surfaces, and said opposing end surfaces of said base, and said polyurea coating is applied to a thickness of between 80 to 150 mils thick.

9. The base according to claim 1, wherein said body made of said rigid polyurethane foam system is coated in a hybrid polyurethane/polyurea coating comprising an isocyanate component and a resin component, said resin component including a blend of amine-terminated polymers and hydroxyl-terminated polymers.

10. The base according to claim 1, wherein said top surface of said body further includes a conduit formed therein, wherein said conduit runs in the same direction as said long axis and said conduit is arranged and configured to receive said electrical wires running from said pumping unit to said junction box.

11. The base according to claim 1, wherein said rigid polyurethane foam system comprises an isocyanate component and a polyol resin component.

* * * * *